US007414510B1

(12) United States Patent
Cheng

(10) Patent No.: US 7,414,510 B1
(45) Date of Patent: Aug. 19, 2008

(54) LOW-PROFILE PLANAR TRANSFORMER

(75) Inventor: Chun-Gheng Cheng, Shenzhen (CN)

(73) Assignee: Kuan Tech (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 11/957,485

(22) Filed: Dec. 17, 2007

(51) Int. Cl.
*H01F 5/00* (2006.01)

(52) U.S. Cl. ..... 336/200

(58) Field of Classification Search ..... 336/65, 336/83, 198, 200, 220–223, 232
See application file for complete search history.

(56) References Cited

U.S. PATENT DOCUMENTS 5,010,314 A * 4/1991 Estrov ..... 336/198
6,636,140 B2 * 10/2003 Fujiyoshi et al. ..... 336/200
7,091,817 B2 * 8/2006 Peck et al. ..... 336/208

* cited by examiner

*Primary Examiner*—Tuyen T. Nguyen

(57) ABSTRACT

A low-profile planar transformer in one embodiment includes a rectangular frame including top and bottom recesses, a first opening through the top and the bottom, a transverse slot open to the other side, and a flange on the other side; a sheet primary winding including a second opening through its top and bottom, the primary winding being adapted to insert into the slot with the other side thereof exposed and the second opening aligned with the first opening; a rectangular secondary winding adapted to put on the recesses; two insulators of U-shaped adapted to clamp front and rear ends of the secondary winding; a first core of E shape; and a second core of sheet shape adapted to couple to the first core by inserting the central ridge of the first core through the first and the second openings with the frame, the windings, and the insulators disposed therebetween.

8 Claims, 3 Drawing Sheets

LOW-PROFILE PLANAR TRANSFORMER

BACKGROUND OF THE INVENTION

1. Field of Invention

The invention relates to planar transformers and more particularly to a small planar transformer having a lower profile than conventional planar transformer.

2. Description of Related Art

Planar transformers are well known in the art. Planar transformers have advantages of having a compact size, a high efficiency, and a good heat dissipation capability.

Moreover, there have been numerous suggestions in prior patents for planar transformers. For example, U.S. Pat. No. 5,010,314 discloses a type of low-profile planar transformer.

Typically, a small planar transformer is mounted in a compact electronic product (e.g., notebook computer, MP3 player, or the like) for supplying required power thereto. However, typical types of planar transformer have a drawback of having a great clearance distance between core and windings due to safety creepage consideration. Thus, typical planar transformers are still relatively bulky as viewed by the inventor.

It is understood that there is a trend of ongoing reduction in size of electrical and electronic equipment. Hence, a further reduction in size of planar transformers is desirable.

SUMMARY OF THE INVENTION

It is therefore one object of the invention to provide a small planar transformer having a lower profile so that insulative clearance and creepage distances required between the primary winding and the secondary winding can be increased to an optimum.

The above and other objects, features and advantages of the invention will become apparent from the following detailed description taken with the accompanying drawings.

DETAILED DESCRIPTION OF THE INVENTION

Figure 1:
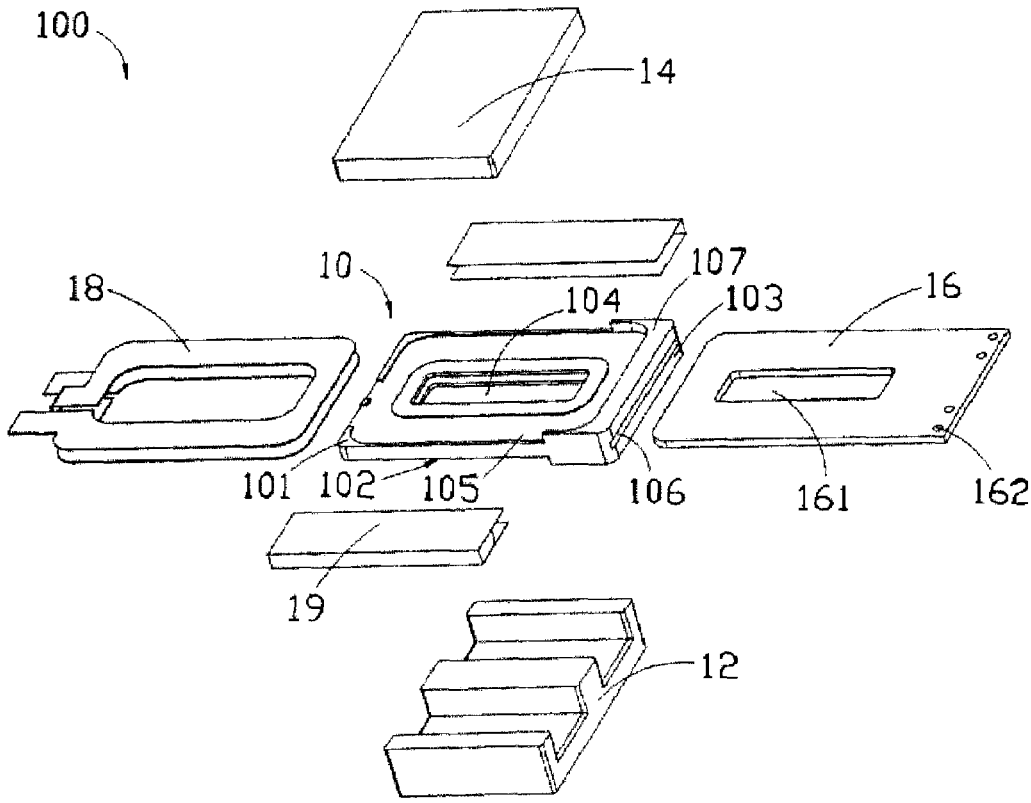
FIG. 1 is an exploded view of a preferred embodiment of planar transformer according to the invention.
Figure 2:
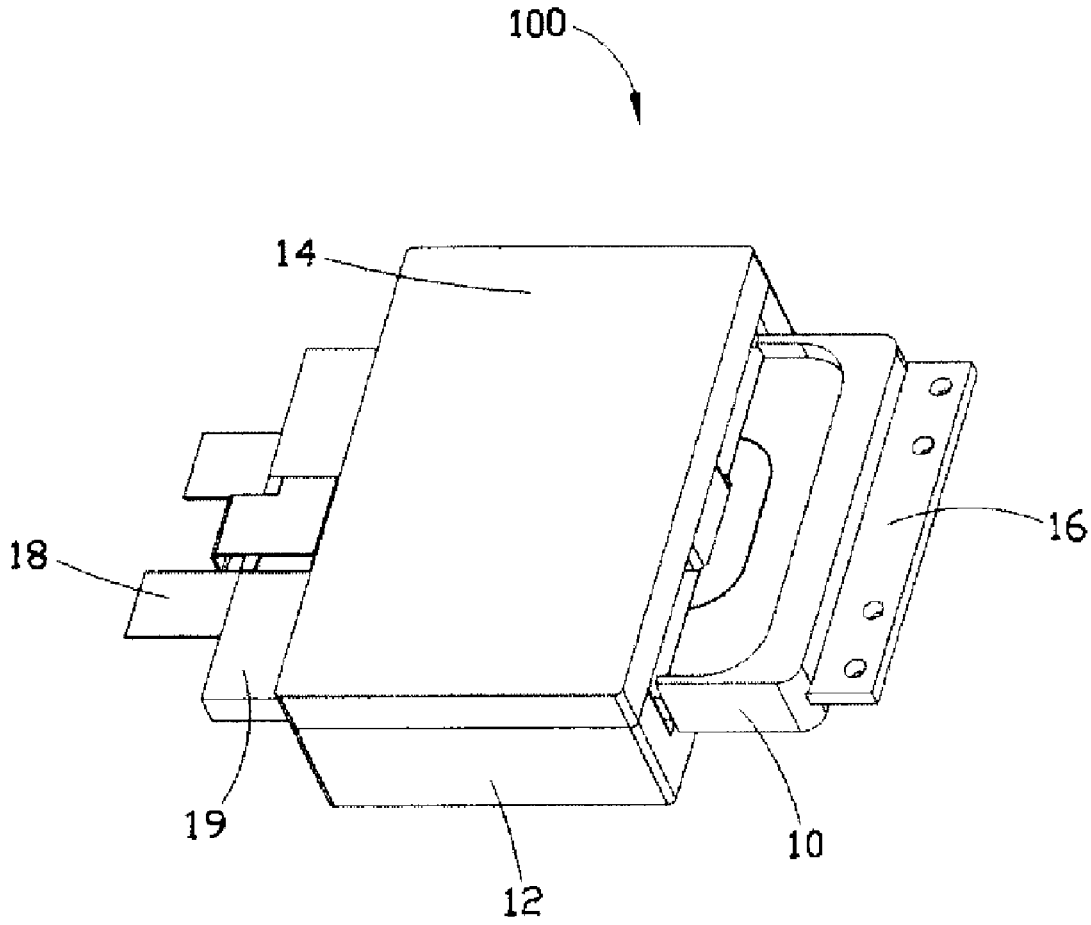
FIG. 2 is a perspective view of the assembled planar transformer.
Figure 3:
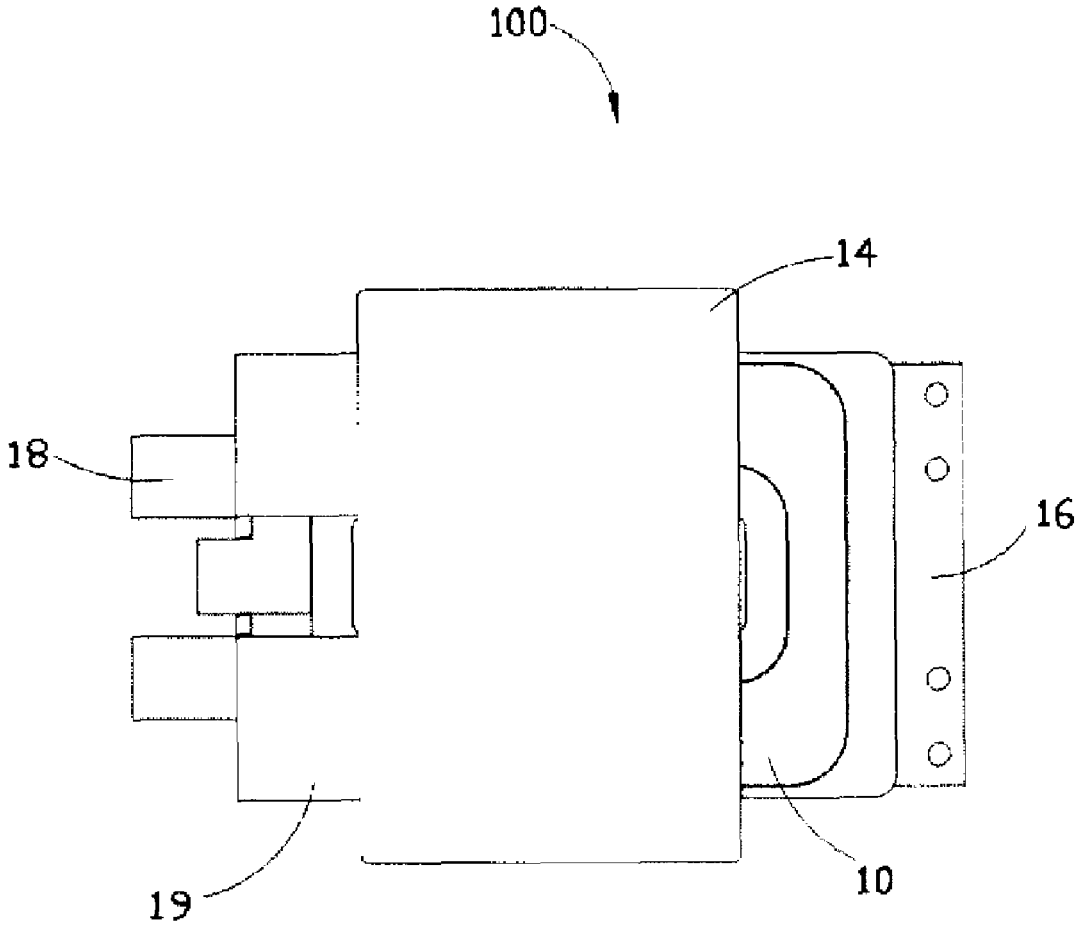
FIG. 3 is a top plan view of the planar transformer shown in FIG. 2.

Referring to FIGS. 1 to 3, a planar transformer 100 in accordance with a preferred embodiment of the invention is shown. The transformer 100 comprises the following components as discussed in detail below.

A frame 10 is mounted between a first core 12 and a second core 14. The frame 10 comprises a hollow, rectangular body (not numbered) having a top surface 101, a bottom surface 102, two sides 103, a central, rectangular opening 104 through the top and bottom surfaces 101 and 102, two recessed structures 105 on the top and bottom surfaces 101 and 102 respectively, and a transverse slot 106 having a blind end proximate one side 103 and the other end open to the other side 103, the slot 106 being in communication with the opening 104.

A primary winding 16 is shaped as a rectangular sheet. The primary winding 16 is implemented as a printed circuit board (PCB). The primary winding 16 comprises a central, rectangular opening 161 through its top and bottom surfaces, and a projection 162 at the other side. The opening 161 is dimensioned to conform to the opening 104. The projection 162 is implemented as a series of conductive contacts (i.e., edge connector) and is adapted to electrically connect to a mating socket (not shown) by plugging thereinto.

A secondary winding 18 is rectangular and is comprised of two spaced, parallel sheets connected together at on side. The secondary winding 18 is implemented as a copper winding or a PCB. The secondary winding 18 has a central opening (not numbered) and a tab (not numbered) at one side. The tab is implemented as a series of conductive contacts (i.e., edge connector) and is adapted to electrically connect to another mating socket (not shown) by plugging thereinto.

A flange 107 is formed on the other side 103 of the frame 10. Both the first core 12 and the second core 14 are made of ferromagnetic core. The first core 12 is E-shaped. The second core 14 is a rectangular plate. Two insulators 19 are formed of a U-shaped inslutating sheet.

An assembly of the invention will be described in detail below. First, insert the primary winding 16 into the slot 106 for fastening with only the projection 162 being exposed. Next, snugly fit the secondary winding 18 on the top and bottom recessed structures 105 by pushing from one side 103 of the frame 10 because the secondary winding 18 is dimensioned to conform thereto. That is, the secondary winding 18 clamps the recessed structures 105. Next, pushing the insulators 19 onto front and rear ends of the secondary winding 18 until the bending portions of the insulators 19 are engaged with and stopped by the front and rear ends of the secondary winding 18. Next, put the second core 14 on the insulators 19. Finally, insert the central ridge of the first core 12 through the openings 104 and 161 to cause the first core 12 to secure to the second core 14 by magnetic attracting force.

The invention has the following advantages. A distance between the primary winding 16 and the secondary winding 18 is greatly decreased. Hence, the physical size of the transformer 100 can be reduced significantly. The flange 107 functions as an insulating member between the primary winding 16 and the secondary winding 18 and thus insulative clearance distances therebetween can be increased. Moreover, the flange 107 can increase insulative clearance distances between the primary winding 16 and the first core 12 and between the secondary winding 18 and the second core 14 respectively. In addition, the flange 107 can increase creepage distances between the primary winding 16 and the secondary winding 18, between the primary winding 16 and the first core 12, and between the secondary winding 18 and the second core 14 respectively. As an end, operating safety of the transformer 100 is greatly increased.

It is seen that insulation between the first core 12 and the secondary winding 18 and insulation between the second core 14 and the secondary winding 18 are effected by the provision of the insulator 19. Alternatively, the insulator 19 can be eliminated if insulation is formed on the secondary winding 18 directly. The secondary winding 18 is comprised of a plurality of laminated layers and the number of the layers may vary depending on output power, current, and/or voltage requirements. Moreover, the insulative clearance distance between the primary winding 16 and the secondary winding 18 can be further increased by increasing the peripheral walls or the depths of the recessed structures 105.

While the invention herein disclosed has been described by means of specific embodiments, numerous modifications and variations could be made thereto by those skilled in the art without departing from the scope and spirit of the invention set forth in the claims.

What is claimed is:

1. A planar transformer comprising:

a rectangular frame including two recessed structures on the top and the bottom respectively, a central first opening through the top and the bottom, a transverse slot having a blind end proximate one side and the other end open to the other side, the slot being in communication with the first opening, and a flange on the other side;

a primary winding of sheet shape, the primary winding including a central second opening through its top and bottom surfaces, the primary winding being adapted to insert into the slot with the other side of the primary winding being exposed and the second opening being aligned with the first opening;

a rectangular secondary winding adapted to put on the recessed structures;

two insulating members of U-shaped adapted to clamp the front and the rear ends of the secondary winding;

a first core of E shape; and a second core of sheet shape adapted to couple to the first core by inserting the central ridge of the first core through the first and the second openings with the frame, the primary winding, the secondary winding, and the insulating members being disposed therebetween.

2. The planar transformer of claim 1, wherein each of the first and the second cores is formed of ferromagnetic material.

3. The planar transformer of claim 1, wherein the primary winding is a printed circuit board (PCB).

4. The planar transformer of claim 1, wherein the secondary winding is either a copper winding or a PCB.

5. A planar transformer comprising:

a rectangular frame including two recessed structures on the top and the bottom respectively, a central first opening through the top and the bottom, a transverse slot having a blind end proximate one side and the other end open to the other side, the slot being in communication with the first opening, and a flange on the other side;

a primary winding of sheet shape, the primary winding including a central second opening through its top and bottom surfaces, the primary winding being adapted to insert into the slot with the other side of the primary winding being exposed and the second opening being aligned with the first opening;

a rectangular secondary winding including two insulating members on the top and the bottom respectively, the secondary winding being adapted to put on the recessed structures;

a first core of E shape; and a second core of sheet shape adapted to couple to the first core by inserting the central ridge of the first core through the first and the second openings with the frame, the primary winding, and the secondary winding being disposed therebetween.

6. The planar transformer of claim 5, wherein each of the first and the second cores is formed of ferromagnetic material.

7. The planar transformer of claim 5, wherein the primary winding is a PCB.

8. The planar transformer of claim 5, wherein the secondary winding is either a copper winding or a PCB.

* * * * *